US012351981B2

(12) United States Patent
Schnelle et al.

(10) Patent No.: US 12,351,981 B2
(45) Date of Patent: Jul. 8, 2025

(54) PROCESS FOR INCREASING DIGESTION EFFICIENCY OF LIGNOCELLULOSIC MATERIAL IN A TREATMENT VESSEL

(71) Applicant: SOLENIS TECHNOLOGIES, L.P., Wilmington, DE (US)

(72) Inventors: Scott Thomas Schnelle, West Grove, PA (US); Daniel Joseph Nicholson, Swarthmore, PA (US); Danyella Oliveira Perissotto, Americana (BR)

(73) Assignee: Solenis Technologies, L.P., Wilmington, DE (US)

( * ) Notice: Subject to any disclaimer, the term of this patent is extended or adjusted under 35 U.S.C. 154(b) by 227 days.

(21) Appl. No.: 18/057,982

(22) Filed: Nov. 22, 2022

(65) Prior Publication Data

US 2023/0160140 A1 May 25, 2023

Related U.S. Application Data

(60) Provisional application No. 63/264,450, filed on Nov. 23, 2021.

(51) Int. Cl.
*D21C 3/22* (2006.01)
*D21C 3/00* (2006.01)
(Continued)

(52) U.S. Cl.
CPC ..... *D21C 3/222* (2013.01); *D21C 3/003* (2013.01); *D21C 3/006* (2013.01); *D21C 3/02* (2013.01); *D21C 3/28* (2013.01)

(58) Field of Classification Search
CPC ..... D21C 3/22; D21C 3/222; D21C 3/003; D21C 3/006; D21C 3/28
See application file for complete search history.

(56) References Cited

U.S. PATENT DOCUMENTS 4,673,460 A * 6/1987 Raff ..... D21C 3/222 162/DIG. 4
5,728,265 A 3/1998 Saint Victor et al.
(Continued)

OTHER PUBLICATIONS

Gortzi et al., "Recovery of Natural Antioxidants from Olive Mill Wastewater Using Genapol-X080.", Journal of the American Oil Chemists' Society, vol. 85, No. 2, 15. Dec. 2007, pp. 133-140, https://doi.org/10.1007/s11746-007-1180-z.
(Continued)

*Primary Examiner* — Anthony Calandra
(74) *Attorney, Agent, or Firm* — Lorenz & Kopf, LLP

(57) ABSTRACT

A process for increasing digestion efficiency of lignocellulosic material in a treatment vessel includes providing lignocellulosic material comprising lignocellulosic biomass, providing an alkyl polyglycoside, an alkoxylated alcohol, and a white liquor comprising sodium hydroxide and sodium sulfide, combining the lignocellulosic material, the alkyl polyglycoside, the alkoxylated alcohol, and the white liquor to form a mixture, and heating the mixture in the treatment vessel to a temperature of from about 125° C. to about 185° C. to digest at least a portion of the lignocellulosic material. The alkyl polyglycoside and the alkoxylated alcohol are present in the mixture in a weight ratio of actives from about 5:95 to about 95:5, respectively. The mixture is free of added surfactants that are not the alkyl polyglycoside and/or the alkoxylated alcohol. The process has increased digestion efficiency as compared to a process that does not utilize a combination of the alkyl polyglycoside and the alkoxylated alcohol.

15 Claims, 3 Drawing Sheets

(51) Int. Cl.
*D21C 3/02* (2006.01)
*D21C 3/28* (2006.01)

(56) References Cited

U.S. PATENT DOCUMENTS

| | | | | |
|---|---|---|---|---|
| 6,036,817 | A | 3/2000 | Victor et al. | |
| 6,123,810 | A * | 9/2000 | Saint Victor | D21C 3/022 516/55 |
| 6,551,452 | B2 | 4/2003 | Wai et al. | |
| 6,740,199 | B2 * | 5/2004 | Khan | D21C 3/222 162/77 |
| 8,920,602 | B2 | 12/2014 | Blackstone et al. | |
| 9,139,955 | B2 | 9/2015 | Joutsimo | |
| 9,579,272 | B2 | 2/2017 | Gelleguillos et al. | |
| 2002/0121348 | A1 * | 9/2002 | Wai | D21C 3/222 162/17 |
| 2015/0140612 | A1 | 5/2015 | Chen et al. | |
| 2019/0226142 | A1 * | 7/2019 | Constantacos | D21C 3/02 |

OTHER PUBLICATIONS

BASF, "Safety Data Sheet Glucopon 600 UP.", BASF, Nov. 15, 2017.
ChemService Inc., "Safety Data Sheet.", ChemService Inc., Apr. 18, 2018.
Clariant, "Genapol X 080.", Clariant, Frankfurt, Germany, Mar. 2006.
ISA/US, International Search Report and Written Opinion issued in Int. Appl. No. PCT/US2022/080320 mailed Mar. 3, 2023.

* cited by examiner

PROCESS FOR INCREASING DIGESTION EFFICIENCY OF LIGNOCELLULOSIC MATERIAL IN A TREATMENT VESSEL

CROSS-REFERENCE TO RELATED APPLICATION

This application claims the benefit of U.S. Provisional Application No. 63/264,450, filed Nov. 23, 2021, which is expressly incorporated herein by reference in its entirety.

TECHNICAL FIELD

The present disclosure generally relates to a process for increasing digestion efficiency of lignocellulosic material in a treatment vessel. More specifically, this disclosure relates to use of an alkyl polyglycoside and an alkoxylated alcohol to synergistically provide increased digestion efficiency as compared to a process that does not utilize a combination of the alkyl polyglycoside and the alkoxylated alcohol.

BACKGROUND

The majority of wood pulps are produced by a sulfate pulping process known as "Kraft" pulping. The process utilizes sodium hydroxide and sodium sulfide added to a medium that is used to cook wood chips and produce pulp. When this technique was introduced over a century ago, the addition of sodium sulfide produced a dramatic improvement in pulp strength, pulp yield, and durability of the paper made therefrom.

In the typical Kraft digestion process, wood chips are added to an aqueous medium including mostly white liquor which becomes dark colored "black liquor" as lignin and wood components are solubilized and dissolved over the course of the cook. Typical white liquor includes a solution of sodium hydroxide, sodium carbonate, sodium sulfate, sodium sulfide and various other inorganic materials. White liquor solubilizes wood components and removes much of the lignin from the chips, resulting in liberated fibers or "pulp" in a solution of "black liquor". In practice, the liquor in which the wood chips are cooked, or cooking liquor, includes a mixture of black and white liquor, the black liquor being liquor added back to the cooking vessel, or digester, from a prior batch of wood chips and the white liquor being a freshly prepared alkaline solution. Black liquor varies considerably among different mills depending on the white liquor used, the wood employed, and the method of cooking.

Ideally, all of the woodchips are cooked uniformly during the digestion process. However, in practice, not all in the fibers in the chips will be separated. Any unseparated fiber bundles will be classified as "rejects". If a quantity of rejects are screened out during this pulping process, a lowered yield (defined as dry weight of pulp produced per unit dry weight of wood consumed) will result.

Certain surfactants and surfactant mixtures are known to provide wetting properties that allow quick and more uniform penetration of the cooking liquor into the capillaries of woodchips. This benefit can be realized in different ways depending on the end goal. For some grades of pulp reducing the "rejects" to increase the yield as well as reducing the cooking time are important. For other grades, reducing chemical consumption and cooking steam usage may be important. Any and all of these benefits may be combined in any way, but it is generally recognized that there is a continuing need for improvements in all of these.

Lignin, in addition to cellulose and hemicellulose, is one of the main constituents of wood. Lignin is a natural, highly aromatic and hydrophobic polymer. For the production of bleaching grade pulp, most of the lignin gets disintegrated and removed from cellulose by Kraft pulping, and additional amounts of lignin are further reduced by a series of bleaching and extraction stages. There is a continuing need for improvement in lignin removal, cooking and bleaching chemical savings, and reduced cooking time.

The production of packaging paper grade pulp with higher lignin content results in a significantly higher overall yield of pulp. A consequence of making this higher lignin content pulp is a higher level of rejects. There is a continuing need for improvement in the reduction of rejects during the production of higher yield higher lignin pulps for packaging.

During the digestion process, various additives can be employed for providing a pulp and/or resulting paper product with desirable characteristics and properties. Additionally, various additives can also be employed to control or enhance the digestion process. For instance, additives can be employed to improve the pulp yield and/or to reduce the number of extractives. Although various agents and processes have been employed to enhance the cooking of wood pulp, many compositions and methods are deficient in producing a reduction in pulp rejects and an increase pulp yield.

As a result, while current methods and compositions exist, there is always a need for an improvement. In particular, there is a need to increase digester efficiency. More specifically, the pulping industry is in need of a more effective surfactant-based digester additive to replace anthraquinone which was commonly used but has recently been delisted by BfR and abandoned by most of the pulp manufacturing community due to concerns over potential toxicity. Existing digester additive product offerings do not meet the requirements or expectations of the pulp manufacturers. Other desirable features and characteristics of the present disclosure will become apparent from the subsequent detailed description of the disclosure and the appended claims, taken in conjunction with the accompanying drawings and this background of the disclosure.

BRIEF SUMMARY

This disclosure provides a process for increasing digestion efficiency of lignocellulosic material in a treatment vessel, the method comprising:

- providing lignocellulosic material comprising lignocellulosic biomass;
- providing an alkyl polyglycoside;
- providing an alkoxylated alcohol;
- providing a white liquor comprising sodium hydroxide and sodium sulfide;
- combining the lignocellulosic material, the alkyl polyglycoside, the alkoxylated alcohol, and the white liquor to form a mixture; and
- heating the mixture in the treatment vessel to a temperature of from about 125° C. to about 185° C. to digest at least a portion of the lignocellulosic material;
- wherein the lignocellulosic material is present in an amount of from about 10 to about 30 weight percent dry material based on a total weight of the mixture;
- wherein the alkyl polyglycoside and the alkoxylated alcohol are present in the mixture in a weight ratio of actives from about 5:95 to about 95:5, respectively;

wherein a combination of the alkyl polyglycoside and the alkoxylated alcohol is present in an amount of from about 0.1 to about 10 kg actives/metric ton dry lignocellulosic material;

wherein the white liquor is present in an amount of from about 70 to about 90 weight percent based on a total weight of the mixture;

wherein the mixture is free of added surfactants that are not the alkyl polyglycoside and/or the alkoxylated alcohol; and wherein the process has an increased digestion efficiency as compared to a process that does not utilize a combination of the alkyl polyglycoside and the alkoxylated alcohol.

This disclosure also provides a mixture comprising:

lignocellulosic material comprising lignocellulosic biomass present in an amount of from about 10 to about 30 weight percent based on a total weight of the mixture;

white liquor comprising sodium hydroxide and sodium sulfide and present in an amount of from about 70 to about 90 weight percent based on a total weight of the mixture;

an alkyl polyglycoside; and an alkoxylated alcohol;

wherein the alkyl polyglycoside and the alkoxylated alcohol are present in the mixture in a weight ratio of actives from about 5:95 to about 95:5, respectively;

wherein a combination of the alkyl polyglycoside and the alkoxylated alcohol is present in an amount of from about 0.1 to about 10 kg actives/metric ton dry lignocellulosic material; and wherein the mixture is free of added surfactants that are not the alkyl polyglycoside and/or the alkoxylated alcohol.

BRIEF DESCRIPTION OF THE DRAWINGS

The present disclosure will hereinafter be described in conjunction with the following drawing figures, wherein like numerals denote like elements.

DETAILED DESCRIPTION

Figure 1:
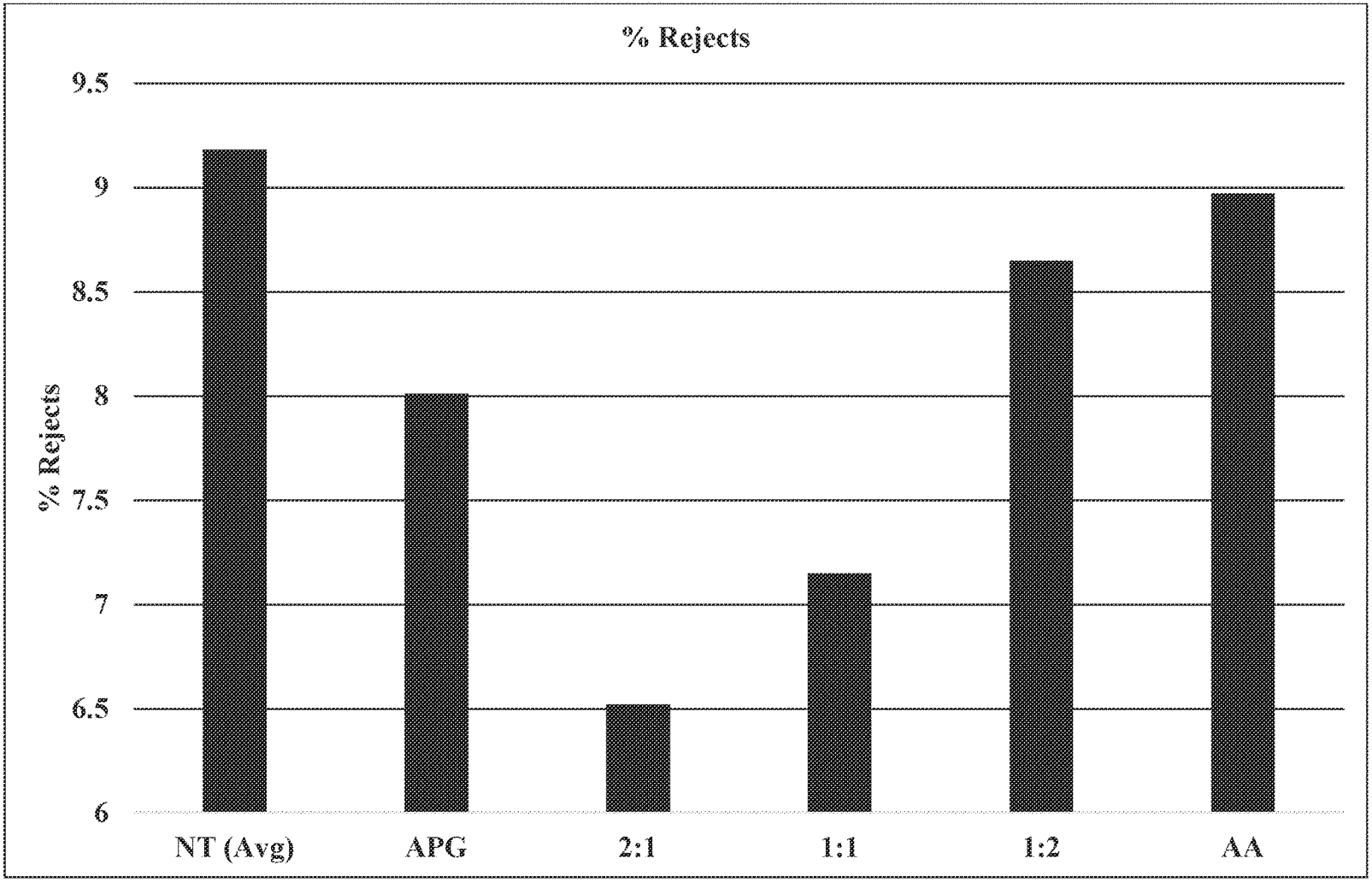
FIG. 1 is a bar-graph showing % rejects as a function of various examples described below.

The following detailed description is merely exemplary in nature and is not intended to limit the process and mixture of this disclosure. Furthermore, there is no intention to be bound by any theory presented in the preceding background or the following detailed description.

Embodiments of the present disclosure are generally directed to lignocellulosic mixtures and processes for digesting the same. For the sake of brevity, conventional techniques related to development and treatment of lignocellulosic materials may not be described in detail herein. Moreover, the various tasks and process steps described herein may be incorporated into a more comprehensive procedure or process having additional steps or functionality not described in detail herein. In particular, various steps in the treatment of lignocellulosic materials are well-known and so, in the interest of brevity, many conventional steps will only be mentioned briefly herein or will be omitted entirely without providing the well-known process details. In this disclosure, the terminology "about" can describe values ±0.1, 0.5, 1, 2, 3, 4, 5, 6, 7, 8, 9, or 10%, in various embodiments. Moreover, it is contemplated that, in various non-limiting embodiments, all values set forth herein may be alternatively described as approximate or "about."

This disclosure provides a process for increasing digestion efficiency of lignocellulosic material in a treatment vessel, the method comprising, consisting essentially of, or consisting of:

providing lignocellulosic material comprising lignocellulosic biomass;

providing an alkyl polyglycoside;

providing an alkoxylated alcohol;

providing a white liquor comprising sodium hydroxide and sodium sulfide;

combining the lignocellulosic material, the alkyl polyglycoside, the alkoxylated alcohol, and the white liquor to form a mixture; and heating the mixture in the treatment vessel to a temperature of from about 125° C. to about 185° C. to digest at least a portion of the lignocellulosic material;

wherein the lignocellulosic material is present in an amount of from about 10 to about 30 weight percent dry material based on a total weight of the mixture;

wherein the alkyl polyglycoside and the alkoxylated alcohol are present in the mixture in a weight ratio of actives from about 5:95 to about 95:5, respectively;

wherein a combination of the alkyl polyglycoside and the alkoxylated alcohol is present in an amount of from about 0.1 to about 10 kg actives/metric ton dry lignocellulosic material weight percent actives based on a total weight of the mixture;

wherein the white liquor is present in an amount of from about 70 to about 90 weight percent based on a total weight of the mixture;

wherein the mixture is free of added surfactants that are not the alkyl polyglycoside and/or the alkoxylated alcohol; and wherein the process has an increased digestion efficiency as compared to a process that does not utilize a combination of the alkyl polyglycoside and the alkoxylated alcohol.

This disclosure also provides a mixture comprising, consisting essentially of, or consisting of:

lignocellulosic material comprising lignocellulosic biomass present in an amount of from about 10 to about 30 weight percent dry material based on a total weight of the mixture;

white liquor comprising sodium hydroxide and sodium sulfide and present in an amount of from about 70 to about 90 weight percent based on a total weight of the mixture;

an alkyl polyglycoside; and an alkoxylated alcohol;

wherein the alkyl polyglycoside and the alkoxylated alcohol are present in the mixture in a weight ratio of actives from about 5:95 to about 95:5, respectively;

wherein a combination of the alkyl polyglycoside and the alkoxylated alcohol is present in an amount of from about 0.1 to about 10 kg actives/metric ton dry lignocellulosic material; and wherein the mixture is free of added surfactants that are not the alkyl polyglycoside and/or the alkoxylated alcohol.

Lignocellulosic Material:

This lignocellulosic material typically includes biomass. This is not limited in its use and can include annual plants and agricultural residues, woody perennials, forestry residues, and trees.

In various embodiments, the lignocellulosic material/biomass can be described as wood or wood chips. For example, the wood may be any wood known in the art that is employed in a pulping process. For instance, the wood may include hardwoods, softwoods, or mixtures thereof. In one embodiment, the wood may include primarily coniferous wood (e.g., spruce, fir, pine, etc.) or primarily deciduous wood (e.g. eucalyptus, poplar, maple, etc.) Typically, the terminology "lignocellulosic material" and/or "biomass" differs from "pulp" herein because pulp is typically what is formed after the lignocellulosic material/biomass has been at least partially digested.

Providing Various Components:

The method includes the steps of providing the lignocellulosic material including the lignocellulosic biomass, providing an alkyl polyglycoside, providing an alkoxylated alcohol, and providing a white liquor comprising sodium hydroxide and sodium sulfide. Each step of providing is not particularly limited and may be independently further defined as importing, creating, shipping, delivering, feeding, etc. or any similar step known in the art. Any one or more components may be introduced or provided via any method known in the art.

Combining to Form a Mixture:

The method also includes the step of combining the lignocellulosic material, the alkyl polyglycoside, the alkoxylated alcohol, and the white liquor to form a mixture or, alternatively, to form a combination or pulp composition. It is contemplated that the mixture of this disclosure may be alternatively described as a combination or pulp composition.

Typically, the mixture is charged to a treatment vessel, such as a digester, and cooked for a predetermined time with a cooking liquor, such as a white liquor described herein. The treatment vessel, such as the digester, is not particularly limited and may be any known in the art. The mixture may be formed in the treatment vessel, apart from the treatment vessel and then added to the treatment vessel, or both in the treatment vessel and apart from the treatment vessel.

The alkyl polyglycoside, the alkoxylated alcohol, and the white liquor may be delivered or transported to contact the lignocellulosic material and form the mixture using any method known in the art. For instance, the one or more components may be added directly to the treatment vessel, such as the digester. Alternatively, one or more components may be added to an input supply stream, such as one for a cooking liquor and then transported to contact the lignocellulosic material. Illustratively, in a batch type digester, the lignocellulosic material and a mixture of "black liquor", i.e., the spent liquor from a previous digester cook, and white liquor and various inorganic materials are pumped into the digester. In the cooking process, lignin, which binds the lignocellulosic material together, is dissolved in the white liquor forming pulp and black liquor. Other suitable additives can be added to the white liquor as well.

This disclosure may provide a reduction in the amount of white liquor required. For instance, the white liquor required may be reduced by about 0.1% or more, such as about 0.5% or more, such as about 1% or more, such as about 1.5% or more, such as about 2% or more, such as about 2.5% or more, such as about 3% or more, such as about 3.5% or more, such as about 5% or more to about 15% or less, such as about 10% or less, such as about 7% or less, such as about 5% or less, such as about 4% or less, such as about 3% or less.

Typically, after the mixture is present, the treatment vessel is sealed and heated to a suitable cook temperature under high pressure to at least partially digest the lignocellulosic material and form a pulp. For example, in various embodiments, the method further includes the step of heating the mixture in the treatment vessel to a temperature of from about 125° C. to about 185° C. to digest at least a portion of the lignocellulosic material. In various embodiments, the temperature is from about 130 to about 175, about 135 to about 170, about 140 to about 165, about 145 to about 160, about 150 to about 155, about 165 to about 180, about 170 to about 175, or about 160, 165, 170, 175, 180, or 185, ° C. In other non-limiting embodiments, it is contemplated that the temperature may be greater or less than the aforementioned ranges so long as the temperature would be recognized by one of skill in the art as sufficient for digesting at least a portion of the lignocellulosic material. In various embodiments, the lignocellulosic material is subjected to alkaline reagents at elevated temperatures and pressures in a treatment vessel, such as the digester, to produce the pulp. In some embodiments, the temperature is from about 200° F. to about 500° F., such as from about 250° F. to about 350° F., and the pressure is from about 60 psi/g to about 130 psi/g. Digestion time may be from about 30 minutes to about 10 hours, depending on the process conditions and the desired pulp/paper characteristics. In various non-limiting embodiments, all values and ranges of value, both whole and fractional, between and including the aforementioned values, are hereby expressly contemplated for use herein.

Reaction conditions present during a cook, or digestion, cause lignin, which is an amorphous polymeric binder found in wood biomass, to be hydrolyzed. Ideally, the lignocellulosic material is digested only long enough to dissolve sufficient lignin to free the fibers, to minimize overcooking and reduction of yield. The pulping process typically attempts to maximize pulp yield, which is defined as the dry weight of pulp produced per unit dry weight of wood consumed.

The lignocellulosic material that is blown from the treatment vessel into the blow tank is typically broken down into separate lignocellulosic fibers. In other words, the fibers originally present in the lignocellulosic material are typically broken apart from one another and separated. In practice, however, some of the fibers fail to separate due, in part, to the undissolved lignin remaining in the pulp. These unseparated fibers are typically removed by passing the pulp through a screen having openings of a predetermined size. In the pulping industry, the standard test screen employed is flat with 0.01 inch slots therethrough.

The materials that are recovered by this screening process are known as "rejects". The rejects include fibers that could be used to produce paper. Accordingly, it is highly desirable to decrease the amount of rejects. One method of lowering the amount of rejects is by increasing the digestion time or by creating more severe hydrolysis conditions. Such conditions, however, increase the costs involved and cause some of the cellulose to be hydrolyzed and rendered unusable. As described herein, the instant disclosure surprisingly and unexpectedly reduces the amount of rejects that are present.

As is known in the art, a Kappa number corresponds directly to the amount of lignin remaining in the pulp. Generally, the higher the Kappa number, the more lignin present in the pulp and, therefore, the higher the pulp yield. The Kappa number generally decreases as the digestion time is increased or the alkalinity of the cooking liquor is increased. A goal in high kappa packaging grade pulping processes is to remove the minimum lignin required for efficient defiberization of the chips. More uniform cooks result in a decreased percentage of rejects and, thereby, increase the yield and production rate of pulp mills. Typically, Kappa number is determined using TAPPI STANDARD T236 (Kappa Number of Pulp).

Cooking or digestion may be terminated when the amount of rejects in the pulp is reduced to an acceptable level. Substantial yield is achieved if the lignocellulosic material is cooked to a higher lignin content while maintain an acceptable rejects level. As a result, an increase in a Kappa number target can result in a substantial cost savings.

Alkyl Polyglycoside

Referring now to the alkyl polyglycoside, also known as APG, used in this disclosure, this compound is not particularly limited and may be any known in the art. In various embodiments, the alkyl polyglycoside has the following structure:

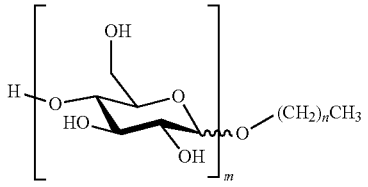

wherein m has an average value of from about 1 to about 3 and n has an average value of from about 5 to about 17. In various embodiments, m has an average value of about 1, about 2, or about 3. In other embodiments, n has an average value of about 5, about 6, about 7, about 8, about 9, about 10, about 11, about 12, about 13, about 14, about 15, about 16, or about 17. In various non-limiting embodiments, all values and ranges of value, both whole and fractional, between and including the aforementioned values, are hereby expressly contemplated for use herein.

In other embodiments, the alkyl polyglycoside is, includes, consists essentially of, or consists of, an oligomeric D-Glucopyranose C10-16 alkyl glycoside. This may be alternatively described as a C10-C16-alkyl polyglucoside. In other embodiments, the alkyl polyglycoside is, includes, consists essentially of, or consists of, an oligomeric D-Glucopyranose C8-C10-alkyl glycoside. This may be alternatively described as a C8-C10-alkyl polyglucoside. In other embodiments, the alkyl polyglycoside is, includes, consists essentially of, or consists of, an oligomeric D-Glucopyranose C10-C16-alkyl glycoside. This may be alternatively described as a C10-C16-alkyl polyglucoside.

Alkoxylated Alcohol:

The alkoxylated alcohol is not particularly limited and may be any known in the art. In various embodiments, the alkoxylated alcohol is, includes, consists essentially of, or consists of, a linear alkyl alcohol alkoxylated with about 1 to about 40 moles of ethylene oxide, propylene oxide, and/or butylene oxide. In other embodiments, the alkoxylated alcohol is, includes, consists essentially of, or consists of, a linear alkyl alcohol having about 6 to about 18 carbon atoms that is alkoxylated with about 1 to about 40 moles of ethylene oxide and/or propylene oxide. In other embodiments, the alkoxylated alcohol is, includes, consists essentially of, or consists of, an eight mole ethoxylate of isotridecyl alcohol. In various embodiments, the linear alkyl alcohol has 6, 7, 8, 9, 10, 11, 12, 13, 14, 15, 16, 17, or 18 carbon atoms. All isomers of these alcohols are also expressly contemplated herein for use. In various embodiments, the moles of ethylene oxide, propylene oxide, and/or butylene oxide is from about 1 to about 35, about 1 to about 30, about 1 to about 25, about 1 to about 20, about 1 to about 15, about 1 to about 10, about 1 to about 5, about 5 to about 40, about 5 to about 35, about 5 to about 30, about 5 to about 25, about 5 to about 20, about 5 to about 15, about 5 to about 10, about 10 to about 40, about 10 to about 35, about 10 to about 30, about 10 to about 25, about 10 to about 20, about 10 to about 15, about 15 to about 40, about 15 to about 35, about 15 to about 30, about 15 to about 25, about 15 to about 20, about 20 to about 40, about 20 to about 35, about 20 to about 30, about 20 to about 25, about 25 to about 40, about 25 to about 35, about 25 to about 30, about 30 to about 40, about 35 to about 40, moles. It is contemplated that the linear alkyl alcohol may be alkoxylated with only ethylene oxide, with only propylene oxide, with only butylene oxide, with a combination of ethylene oxide and propylene oxide, with a combination of ethylene oxide and butylene oxide, or with a combination of propylene oxide and butylene oxide. The alkoxylation may be further described as random or block or may include both random and block alkoxylation. In various non-limiting embodiments, all values and ranges of value, both whole and fractional, between and including the aforementioned values, are hereby expressly contemplated for use herein.

In various embodiments, the alkyl polyglycoside and the alkoxylated alcohol are present in the mixture in a weight ratio of actives from about 0.1:99.9 to about 99.9:0.1, about 0.5:99.5 to about 99.5:0.5, about 1:99 to about 99:1, about 5:95 to about 95:5, about 10:90 to about 90:10, about 15:85 to about 85:15, about 20:80 to about 80:20, about 25:75 to about 75:25, about 30:70 to about 70:30, about 35:65 to about 65:35, about 40:60 to about 60:40, about 45:55 to about 55:45, or about 50:50, respectively. In other embodiments, the alkyl polyglycoside and the alkoxylated alcohol are present in the mixture in a weight ratio of actives from about 1:4 to about 4:1, about 1:3 to about 3:1, about 1:2 to about 2:1, or about 1:2, about 2:1, about 1:3, about 3:1, about 1:4, or about 4:1, respectively. In one embodiment, the alkyl polyglycoside and the alkoxylated alcohol are present in the mixture in a weight ratio of actives from about 25:75 to about 75:25. In another embodiment, the alkyl polyglycoside and the alkoxylated alcohol are present in the mixture in a weight ratio of actives of about 2:1. In various non-limiting embodiments, all values and ranges of value, both whole and fractional, between and including the aforementioned values, are hereby expressly contemplated for use herein.

In one embodiment, the alkyl polyglycoside is, includes, consists essentially of, or consists of, an oligomeric D-Glucopyranose C10-16 alkyl glycoside and the alkoxylated alcohol is, includes, consists essentially of, or consists of, an eight mole ethoxylate of isotridecyl alcohol. In a related embodiment, the alkyl polyglycoside and the alkoxylated alcohol are present in the mixture in a weight ratio of actives of about 2:1.

In various embodiments, the mixture is, includes, consists essentially of, or consists of, the lignocellulosic material, the alkyl polyglycoside, the alkoxylated alcohol, and the white liquor. In other embodiments, the mixture is, includes, consists essentially of, or consists of, the lignocellulosic material, the alkyl polyglycoside, the alkoxylated alcohol, and the white liquor, and wherein the alkyl polyglycoside is an oligomeric D-Glucopyranose C10-16 alkyl glycoside, the alkoxylated alcohol is an eight mole ethoxylate of isotridecyl alcohol, and the alkyl polyglycoside and the alkoxylated alcohol are present in the mixture in a weight ratio of actives of about 2:1.

In other embodiments, the alkyl polyglycoside and the alkoxylated alcohol are present in the mixture in an amount of from about 0.1 to about 99, weight percent actives based on a total weight of the mixture. In various embodiments, a combination of the alkyl polyglycoside and the alkoxylated alcohol is present in an amount of from about 0.1 to about 10 kg actives/metric ton dry lignocellulosic material or from about 0.5 to about 2, about 1 to about 1.5, about 0.5 to about 1, about 0.5 to about 1.5, or about 0.1, 0.2, 0.3 . . . 1, 2, 3 . . . up to about 10, kg actives/metric ton dry lignocellulosic material In various non-limiting embodiments, all values and ranges of value, both whole and fractional, between and including the aforementioned values, are hereby expressly contemplated for use herein.

In still other embodiments, the white liquor is present in an amount of from about 0.1 to about 99 weight percent based on a total weight of the mixture. In various embodiment, the white liquor is present in an amount of from about 70 to about 90, about 75 to about 85, or about 75 to about 80, weight percent actives based on a total weight of the mixture. In various non-limiting embodiments, all values and ranges of value, both whole and fractional, between and including the aforementioned values, are hereby expressly contemplated for use herein.

Typically, the mixture is free of added surfactants that are not the alkyl polyglycoside and/or the alkoxylated alcohol. The terminology "added" surfactants differentiates those surfactants added to the pulping process and any surfactants produced in-situ via the pulping process such as tall oil soaps. Therefore, in various embodiments, the mixture is free of surfactants added thereto but may include in-situ created surfactants such as tall oil soaps and the like, as would be understood by those of skill in the art.

In various embodiments, the terminology "free of" describes that the mixture includes less than 10, 9, 8, 7, 6, 5, 4, 3, 2, 1, 0.5, or 0.1, weight percent actives of surfactants that are not the alkyl polyglycoside and/or the alkoxylated alcohol. Alternatively, the terminology "free of" may describe that the mixture includes zero weight percent actives of surfactants that are not the alkyl polyglycoside and/or the alkoxylated alcohol. In various non-limiting embodiments, all values and ranges of value, both whole and fractional, between and including the aforementioned values, are hereby expressly contemplated for use herein.

In various embodiments described throughout this disclosure, the terminology "consists essentially of" may describe one or more embodiments that are free of added surfactants that are not the alkyl polyglycoside and/or the alkoxylated alcohol, embodiments that are free of one or more additives not described herein and/or those described as optional herein, embodiments that are free of one or more types of pulp that are not described herein and/or are described as optional herein, embodiments that are free of one or more types of white and/or black and/or cooking liquors that are not described herein and/or that are described as optional herein, etc.

In various embodiments, the instant disclosure, e.g. process, mixture, composition, etc., may be free of or include less than 10, 9, 8, 7, 6, 5, 4, 3, 2, 1, 0.5, or 0.1, weight percent actives of one or more of an anionic surfactant, derivatives thereof, salts thereof, or any combinations thereof. For example, such anionic surfactants may include, but are not limited to, a sulfonic acid, a sulfate, a carboxylate or carboxylic acid, a phosphate, a polyoxyalkylene glycol, polyalkylene glycol-polyalkylene glycol copolymer, or a derivative thereof, or a copolymer thereof, or a salt thereof, or any combination thereof. In other embodiments, the instant disclosure, e.g. process, mixture, composition, etc., may be free of or include less than 10, 9, 8, 7, 6, 5, 4, 3, 2, 1, 0.5, or 0.1, weight percent actives of one or more of unrefined fatty acids include, but are not limited to, coconut oil, cochin oil, corn oil, cottonseed oil, linseed oil, olive oil, palm oil, palm kernel oil, peanut oil, soybean oil, sunflower oil, tall oils, tallow, lesquerella oil, tung oil, whale oil, tea seed oil, sesame seed oil, safflower oil, rapeseed oil, fish oils, avocado oil, mustard oil, rice bran oil, almond oil, walnut oil, derivatives thereof, and combinations thereof.

In various embodiments, the instant disclosure, e.g. process, mixture, composition, etc., may include, may be free of, or may include less than 10, 9, 8, 7, 6, 5, 4, 3, 2, 1, 0.5, or 0.1, weight percent actives of one or more of a carrier, e.g. which may be employed for transporting or delivering any component described herein. Typically, this disclosure involves water pulping and not solvent pulping. For example, the carrier may be water, an organic solvent, an alcohol, etc. In various embodiments, a carrier is utilized in an amount of 20 wt. % or more, such as 30 wt. % or more, such as 40 wt. % or more, such as 50 wt. % or more, such as 60 wt. % or more, such as 70 wt. % or more, such as about 80 wt, % or more to less than 100 wt. %, such as about 99 wt. % or less, such as about 95 wt. % or less, such as about 90 wt. % or less, such as about 80 wt. % or less, based on the weight of the mixture.

In various embodiments, the process of this disclosure exhibits an increased digestion efficiency as compared to a process that does not utilize a combination of the alkyl polyglycoside and the alkoxylated alcohol. This increased digestion efficiency may be expressed in various ways.

For example, and as first introduced above, it is well known that in various types of pulping processes lignocellulosic materials are blown from the treatment vessel into a blow tank and then broken down into separate wood fibers. In practice, however, some of the lignocellulosic materials fail to completely separate due, in part, to the undissolved lignin. These unseparated materials are removed by passing through a screen having openings of a predetermined size. In the pulping industry, the standard test screen employed is flat with about 0.01 inch slots therethrough. The materials recovered by this screening process are known as "rejects". The rejects include fibers that could be used to for the desired outcome. Accordingly, it is highly desirable to decrease the amount of rejects. One method of lowering the amount of rejects is by increasing the digestion time or by creating more severe hydrolysis conditions. Such conditions, however, increase the costs involved and cause some of the cellulose in the wood chips to be hydrolyzed and rendered unusable. Therefore, the process of the instant disclosure surprisingly, unexpectedly, and with superior efficiency, can reduce the amount of rejects, as described above, thereby indicating increased digestion efficiency. In various embodiments, the percent rejects are less than about 30, 25, 20, 15, 10, 9, 8, 7, 6, 5, 4, 3, 2, 1, or 0.5, weight percent, based on a total original weight percent of the lignocellulosic materials added to the treatment vessel. In various non-limiting embodiments, all values and ranges of value, both whole and fractional, between and including the aforementioned values, are hereby expressly contemplated for use herein.

In other embodiments, the instant process may provide an improvement in the pulp yield by about 0.01% to about 5% calculated based on weight of useable fiber derived from the process/weight of the oven dried wood at the start. In various non-limiting embodiments, all values and ranges of value, both whole and fractional, between and including the aforementioned values, are hereby expressly contemplated for use herein.

In other embodiments, the instant process may provide a reduction in the amount of white liquor required. For instance, the white liquor required may be reduced by about 0.1% or more, such as about 0.5% or more, such as about 1% or more, such as about 1.5% or more, such as about 2% or more, such as about 2.5% or more, such as about 3% or more, such as about 3.5% or more, such as about 5% or more to about 15% or less, such as about 10% or less, such as about 7% or less, such as about 5% or less, such as about 4% or less, such as about 3% or less. In various non-limiting embodiments, all values and ranges of value, both whole and fractional, between and including the aforementioned values, are hereby expressly contemplated for use herein.

In still other embodiments, the instant process provides a reduction in kappa number, which is indicative of the amount of residual lignin on the fibers. Typically, the kappa number is determined using TAPPI STANDARD T236 (Kappa Number of Pulp). In various non-limiting embodiments, all values and ranges of value, both whole and fractional, between and including the aforementioned values, are hereby expressly contemplated for use herein.

In other embodiments, the instant process provides an increase in residual active alkali, also known as RA. Typically, the RA is determined using SCAN-N 33:94. In various embodiments, the RA is at least about 5 to about 15, about 10 to about 15 or about 5 to about 10, g/L. In various non-limiting embodiments, all values and ranges of value, both whole and fractional, between and including the aforementioned values, are hereby expressly contemplated for use herein.

In still other embodiments, it is observed that a synergistic mixture affords a pulp with a lower reject count and a lower lignin content (corresponding to ~kappa number units) with increased yield.

EXAMPLES

Hardwood and/or softwood woodchips were added into a circulating laboratory digester (M/K Systems) along with white liquor in a ratio of 1:4.5.

In a control sample, no treatment was added. In other words, the alkyl polyglycoside and alkoxylated alcohol were not added. This is indicated below as No Treatment (NT).

In a Comparative Sample A, an alkyl polyglycoside was added but no alkoxylated alcohol was added. This is indicated below as alkyl polyglycoside (APG).

In a Comparative Sample B, an alkoxylated alcohol was added but no alkyl polyglycoside was added. This is indicated below as alkoxylated alcohol (AA).

In an Inventive Sample, both an alkyl polyglycoside and alkoxylated alcohol were added. This indicated below as Mixture 1.

Figure 2:
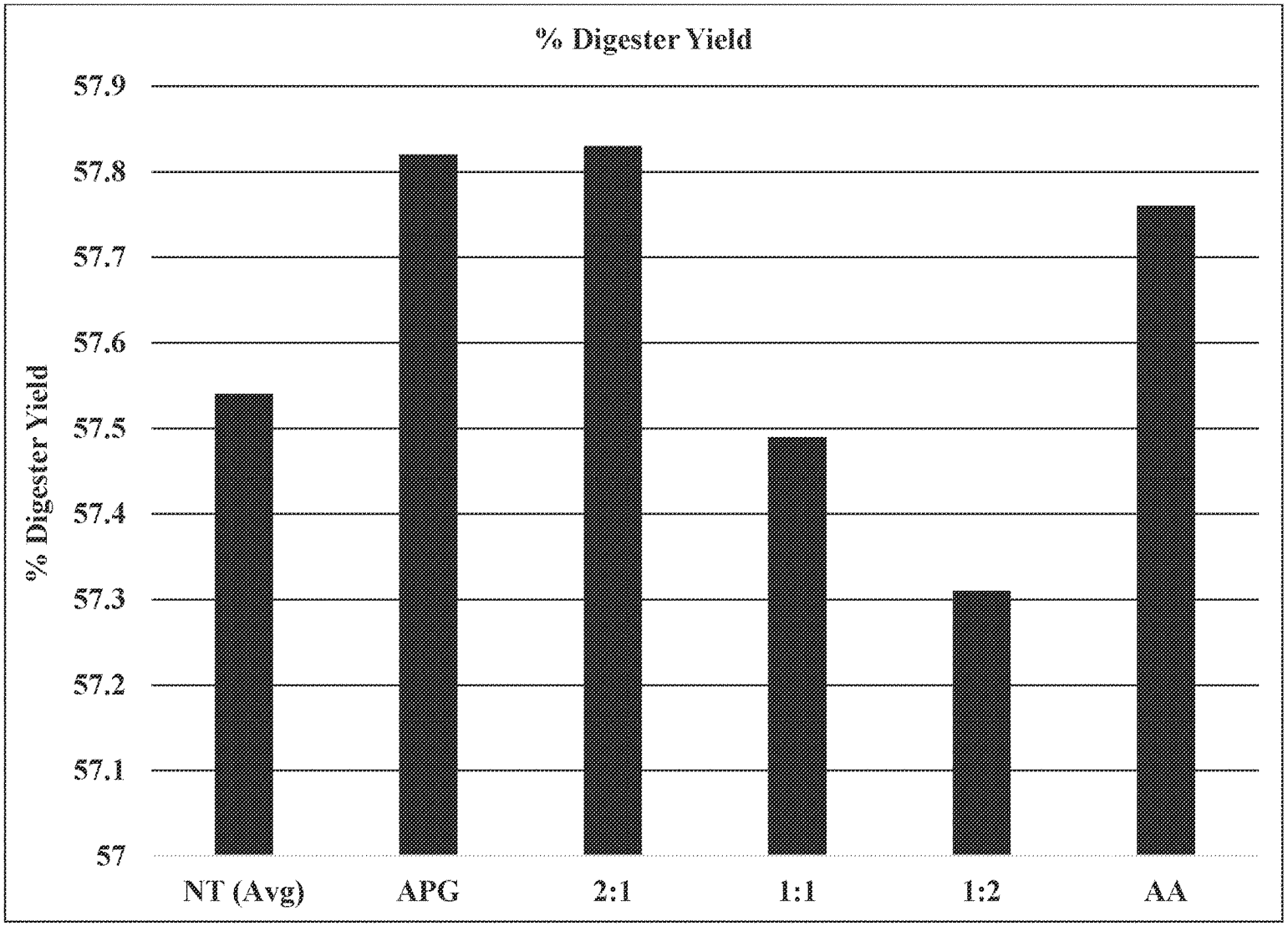
FIG. 2 is a bar-graph showing % digester yield as a function of various examples described below.
Figure 3:
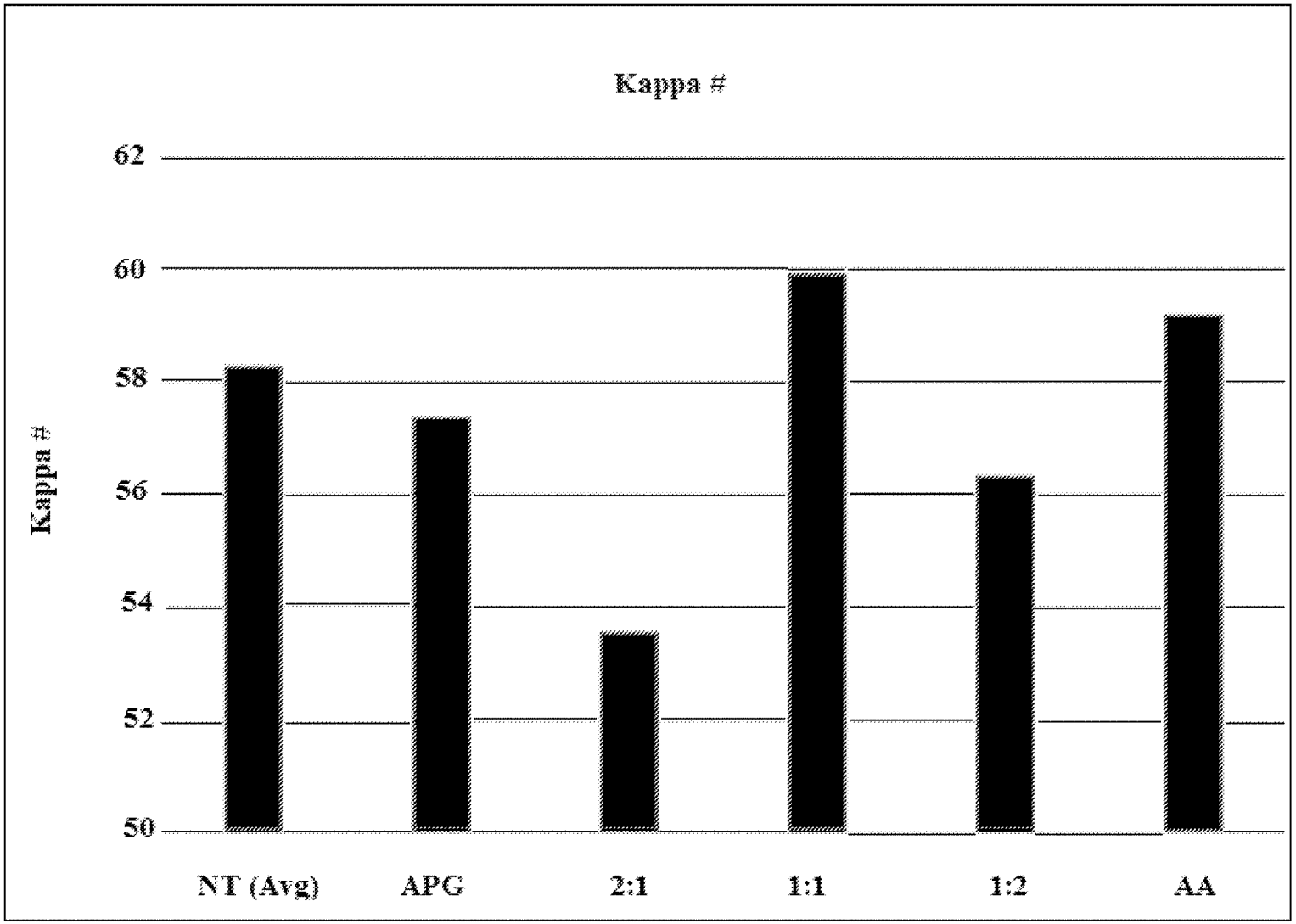
FIG. 3 is a bar-graph showing Kappa Number as a function of various examples described below.

After the above compounds were added, if any, the digester was sealed, and the mixture was heated to attain a certain H-Factor. H-Factor is a single numerical value for expressing the 2 combined values of digester time and pulping temperature. All comparable tests were conducted using the same H-Factor, i.e. (GD H=165) depending by the Woodchips type used. The Woodchips were deliberately undercooked using the same H-Factor. This was to help in determining the discernible differences after each digestion, especially in % yield, % rejects and Kappa numbers. The test results are set forth in Table 1 that follows and shown in FIGS. 1-3:

TABLE 1

| Example | | % Rejects | % Digester Yield | Kappa # |
|---|---|---|---|---|
| Control | No Treatment (NT) (Avg) | 9.18 | 57.54 | 58.31 |
| Comp A | Alkyl Polyglycoside (APG) | 8.01 | 57.82 | 57.4 |
| Comp B | Alkoxylated Alcohol (AA) | 8.97 | 57.76 | 59.21 |
| Mixture 1 | Mixture of Alkyl Polyglycoside:Alkoxylated Alcohol (2:1 by weight) | 6.52 | 57.83 | 53.56 |

In the above, the lignocellulosic material is Eucalyptus hardwood chips.

The weight percent of the lignocellulosic material is 18.18% weight percent based on a total weight of the mixture. This can be alternatively expressed as dry lignocellulosic material is 1 part out of 5.5 total parts of the mixture.

The alkyl polyglycoside is an oligomeric D-Glucopyranose C10-16 alkyl glycoside.

The alkoxylated alcohol is an eight mole ethoxylate of isotridecyl alcohol.

The weight ratio of actives of the alkyl polyglycoside: alkoxylated alcohol is 2:1.

The total weight of the actives of the alkyl polyglycoside and the alkoxylated alcohol is 0.01818% weight percent based on a total weight of the mixture. The total weight of the actives of the alkyl polyglycoside and the alkoxylated alcohol is 0.1% weight percent based on a total weight of the dry lignocellulosic material.

The white liquor is 1.29 wt % $Na_2S$ and 3.98 wt % NaOH in water and is present in the mixture in an amount of 81.82% weight percent based on a total weight of the mixture.

The % reject for the Control at 9.18 was high. Although it had a high % yield of 57.54, this high % yield could be explained by the presence of a substantial amount of undissolved lignin. This was verified by its Kappa number of 58.31 as expected.

Comparative Example A (APG, which is Glucopon 425N) had a high yield and low Kappa number. The low Kappa number demonstrated that APGs are effective pulping aids.

Comparative Example B (AA) had a higher Kappa number of 57.4, and was less effective than APGs. The % of rejects at 8.97 was also high.

Mixture 1 provides a higher yield and a lower Kappa number than the control. Mixture 1 also demonstrates a superior and unexpected synergistic effect as compared to both APG and AA when used alone.

The data generated in the aforementioned tests shows that the mixture of the alkyl polyglycoside and the alkoxylated alcohol is a superior digester additive as compared to either the alkyl polyglycoside or the alkoxylated alcohol on its own.

These results were unanticipated and represent a beneficial synergistic effect afforded a pulp with a lower reject count and a lower lignin content (corresponding to ~kappa number units). Total digester yield was improved as well. This represents a significant improvement in delignification efficacy.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing an exemplary embodiment. It being understood that various changes may be made in the function and arrangement of elements described in an exemplary embodiment without departing from the scope as set forth in the appended claims.

What is claimed is:

1. A process for increasing digestion efficiency of lignocellulosic material in a treatment vessel, said method comprising:

providing lignocellulosic material comprising lignocellulosic biomass;

providing an alkyl polyglycoside;

providing an alkoxylated alcohol having a single (—OH) group and comprising an eight mole ethoxylate of isotridecyl alcohol;

providing a white liquor comprising sodium hydroxide and sodium sulfide;

combining the lignocellulosic material, the alkyl polyglycoside, the alkoxylated alcohol, and the white liquor to form a mixture; and heating the mixture in the treatment vessel to a temperature of from about 125° C. to about 185° C. to digest at least a portion of the lignocellulosic material;

wherein the lignocellulosic material is present in an amount of from about 10 to about 30 weight percent based on a total weight of the mixture;

wherein the alkyl polyglycoside and the alkoxylated alcohol are present in the mixture in a weight ratio of actives from about 5:95 to about 95:5, respectively;

wherein a combination of the alkyl polyglycoside and the alkoxylated alcohol is present in an amount of from 0.1 to about 10 kg actives/metric ton dry lignocellulosic material;

wherein the white liquor is present in an amount of from about 70 to about 90 weight percent based on a total weight of the mixture;

wherein the mixture is free of added surfactants that are not the alkyl polyglycoside and/or the alkoxylated alcohol; and wherein said process has an increased digestion efficiency as compared to a process that does not utilize a combination of the alkyl polyglycoside and the alkoxylated alcohol.

2. The process of claim 1 wherein the alkyl polyglycoside has the following structure:

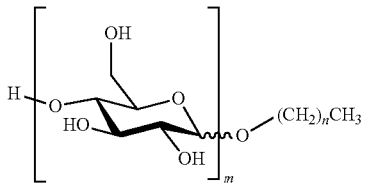

wherein m has an average value of from about 1 to about 3 and n has an average value of from about 5 to about 17.

3. The process of claim 1 wherein the alkyl polyglycoside comprises an oligomeric D-Glucopyranose C10-16 alkyl glycoside.

4. The process of claim 3 wherein the alkyl polyglycoside and the alkoxylated alcohol are present in the mixture in a weight ratio of actives of about 2:1.

5. The process of claim 1 wherein the alkyl polyglycoside and the alkoxylated alcohol are present in the mixture in a weight ratio of actives from about 25:75 to about 75:25.

6. The process of claim 1 wherein the alkyl polyglycoside and the alkoxylated alcohol are present in the mixture in a weight ratio of actives of about 2:1.

7. The process of claim 1 wherein the mixture consists essentially of the lignocellulosic material, the alkyl polyglycoside, the alkoxylated alcohol, and the white liquor.

8. The process of claim 1 wherein the mixture consists essentially of the lignocellulosic material, the alkyl polyglycoside, the alkoxylated alcohol, and the white liquor, and wherein the alkyl polyglycoside is an oligomeric D-Glucopyranose C10-16 alkyl glycoside, the alkoxylated alcohol is an eight mole ethoxylate of isotridecyl alcohol, and the alkyl polyglycoside and the alkoxylated alcohol are present in the mixture in a weight ratio of actives of about 2:1.

9. A mixture comprising:

lignocellulosic material comprising lignocellulosic biomass present in an amount of from about 10 to about 30 weight percent based on a total weight of said mixture;

white liquor comprising sodium hydroxide and sodium sulfide and present in an amount of from about 70 to about 90 weight percent based on a total weight of said mixture;

an alkyl polyglycoside; and an alkoxylated alcohol having a single (—OH) group and comprising an eight mole ethoxylate of isotridecyl alcohol;

wherein said alkyl polyglycoside and said alkoxylated alcohol are present in said mixture in a weight ratio of actives from about 5:95 to about 95:5, respectively;

wherein a combination of said alkyl polyglycoside and said alkoxylated alcohol is present in an amount of from about 0.1 to about 10 kg actives/metric ton dry lignocellulosic material; and wherein said mixture is free of added surfactants that are not said alkyl polyglycoside and/or said alkoxylated alcohol.

10. The mixture of claim 9 wherein said alkyl polyglycoside and said alkoxylated alcohol are present in said mixture in a weight ratio of actives from about 25:75 to about 75:25.

11. The mixture of claim 9 wherein said alkyl polyglycoside and said alkoxylated alcohol are present in said mixture in a weight ratio of actives of about 2:1.

12. The mixture of claim 9 wherein said alkyl polyglycoside comprises an oligomeric D-Glucopyranose C10-16 alkyl glycoside.

13. The mixture of claim 12 wherein said alkyl polyglycoside and said alkoxylated alcohol are present in said mixture in a weight ratio of actives of about 2:1.

14. The mixture of claim 9 that consists essentially of said lignocellulosic material, said alkyl polyglycoside, said alkoxylated alcohol, and said white liquor, and wherein said alkyl polyglycoside is an oligomeric D-Glucopyranose C10-16 alkyl glycoside, said alkoxylated alcohol is an eight mole ethoxylate of isotridecyl alcohol, and said alkyl polyglycoside and said alkoxylated alcohol are present in said mixture in a weight ratio of actives of about 2:1.

15. A mixture comprising:

lignocellulosic material comprising lignocellulosic biomass that is Eucalyptus hardwood chips and present in an amount of about 18 weight percent based on a total weight of said mixture;

white liquor comprising sodium hydroxide and sodium sulfide and present in an amount of from about 70 to about 90 weight percent based on a total weight of said mixture;

an alkyl polyglycoside that is an oligomeric D-Glucopyranose C10-16 alkyl glycoside; and an alkoxylated alcohol having a single (—OH) group and that is an eight mole ethoxylate of isotridecyl alcohol;

wherein said alkyl polyglycoside and said alkoxylated alcohol are present in said mixture in a weight ratio of actives that is 2:1;

wherein a combination of said alkyl polyglycoside and said alkoxylated alcohol is present in an amount of from about 0.1 to about 10 kg actives/metric ton dry lignocellulosic material;

wherein a total weight of the actives of said alkyl polyglycoside and said alkoxylated alcohol is about 0.1% weight percent based on a total weight of the dry lignocellulosic material; and wherein said mixture is free of added surfactants that are not said alkyl polyglycoside and/or said alkoxylated alcohol.

* * * * *